US005084733A

United States Patent [19]

Katoh et al.

[11] Patent Number: 5,084,733

[45] Date of Patent: Jan. 28, 1992

[54] DEVELOPING APPARATUS HAVING DEVELOPER LAYER REGULATION MEANS

[75] Inventors: Motoi Katoh, Yokohama; Takashi Hino; Michihito Yamazaki, both of Tokyo; Keiji Okano, Yokohama; Yasushi Sato; Kimio Nakahata, both of Kawasaki, all of Japan

[73] Assignee: Canon Kabushiki Kaisha, Tokyo, Japan

[21] Appl. No.: 261,999

[22] Filed: Oct. 25, 1988

[30] Foreign Application Priority Data

Oct. 28, 1987 [JP] Japan ..... 62-274251
Oct. 28, 1987 [JP] Japan ..... 62-274253

[51] Int. Cl.[5] ..... G03G 15/09

[52] U.S. Cl. ..... 355/251; 118/657; 355/253

[58] Field of Search ..... 355/245, 251, 253, 259; 118/644, 657, 658

[56] References Cited

U.S. PATENT DOCUMENTS

| | | | |
|---|---|---|---|
| 3,915,121 | 10/1975 | Wilcox | 118/637 |
| 4,213,617 | 7/1980 | Salger | 277/12 |
| 4,227,797 | 10/1980 | Tsunoi | 355/259 X |
| 4,387,664 | 6/1983 | Hosono et al. | 355/253 X |
| 4,579,082 | 4/1986 | Murasawa et al. | 118/658 |
| 4,596,455 | 6/1986 | Kohyama et al. | 355/259 X |
| 4,597,661 | 7/1986 | Yamashita | 355/251 X |
| 4,656,965 | 4/1987 | Hosoya et al. | 118/649 |
| 4,662,311 | 5/1987 | Shoji et al. | 118/658 X |
| 4,806,992 | 2/1989 | Yasuda et al. | 355/259 |
| 4,819,027 | 4/1989 | Murasaki et al. | 118/657 X |

FOREIGN PATENT DOCUMENTS

| | | | |
|---|---|---|---|
| 0060030 | 9/1982 | European Pat. Off. . | |
| 0138458 | 4/1985 | European Pat. Off. . | |
| 59-170869 | 9/1984 | Japan . | |
| 60-126674 | 7/1985 | Japan . | |
| 60-151668 | 8/1985 | Japan . | |
| 0223868 | 10/1986 | Japan | 355/245 |
| 62-70884 | 4/1987 | Japan . | |
| 2006054 | 5/1979 | United Kingdom . | |

OTHER PUBLICATIONS

Japanese Abstract, 62-70884, vol. 11, No. 270, (P-611) [2717] Sep. 3, 1987.

*Primary Examiner*—A. T. Grimley
*Assistant Examiner*—Nestor R. Ramirez
*Attorney, Agent, or Firm*—Fitzpatrick, Cella, Harper & Scinto

[57] ABSTRACT

A developing apparatus including a developer carrying member for carrying a developer, a magnet disposed in the developer carrying member, and an elastic regulating member contacting the developer carrying member to regulate a thickness of a layer of the developer formed on the developer carrying member. The developer carrying member has a roughened surface over a width thereof larger than a width of the portion of the elastic regulating member contacting the developer carrying member while the magnet forms a magnetic field in a marginal region of the roughened surface of the developer carrying member not contacting the elastic regulating member to remove magnetic developer.

17 Claims, 8 Drawing Sheets

DEVELOPING APPARATUS HAVING DEVELOPER LAYER REGULATION MEANS

FIELD OF THE INVENTION AND RELATED ART

The present invention relates to a developing apparatus for developing an electrostatic latent image.

Generally, in an image forming apparatus such as an electrophotographic machine, a developer carrying member, usually a sleeve, of a developing device is disposed relative to an electrophotographic photosensitive member for carrying an electrostatic latent image with a predetermined clearance therebetween, and a proper bias voltage is applied therebetween to develop the latent image.

As for the developing methods, there are various proposals such as a so-called jumping development disclosed in U.S. Pat. No. 4,395,476 or float electrodes development method as disclosed in Japanese Laid-Open Patent Application No. 97071/1983, and they are used in commercial products.

FIG. 1 shows an example of the developing apparatus, wherein a developer T is applied in a developer container and is formed into a developer layer 3 by a regulating member closely disposed or contacted to the sleeve 2, and the developer layer 3 is carried on the sleeve 2 to the neighborhood of the latent image bearing member 1 such as an electrophotographic photosensitive member or the like rotating in the direction indicated by an arrow, where the latent image is developed. During the development, a DC or an AC voltage is applied between the sleeve 2 and the latent image bearing member 1, if desired. It is important, particularly in a developing device using a one component developer, to form a layer of the developer on the sleeve, in order to assure uniformity of a solid black image. To achieve this, there are various proposals such as using an insulative regulating member, a conductive member, a polarizable or non-polarizable material.

U.S. Pat. Nos. 4,458,627, 4,395,476, 4,377,332, 4,380,966 and Japanese Laid-Open Patent Application No. 116559/1983 disclose methods of forming a thin layer of a developer using an elastic member contacted to a sleeve. Those methods are good in that the developer layer formation and the triboelectric charge application are very stable against variation of external ambient conditions.

FIG. 2 shows a schematic view of a developing apparatus using those methods. In this Figure the same reference numerals 1–4 are assigned to the corresponding elements in FIG. 1. Designated by a reference 5 is the elastic regulating member in the form of a blade contacted to the sleeve 2.

However, the regulating member is an elastic member in the form of a blade, the developer is easily overflowed adjacent opposite longitudinal ends of the regulating member, which results in contamination of the apparatus. As measures for avoiding this, a sealing member disclosed in U.S. Pat. Nos. 4,341,179, 4,373,468 and 4,387,664 is used, and a soft sealing material such as moltplane and felt is packed into the space between the casing of the developing device and longitudinal end portions of the elastic regulating member to minimize the overflow or leakage.

However, it is difficult to mount the material with sufficient precision. More particularly, the packed material pushes up the end portions of the elastic regulating member with the result that the contact pressure of the regulating member to the sleeve is different in the end portions than in the central portion, and therefore, the density of the developed image becomes non-uniform. As another method, scatter preventing members are abutted to opposite longitudinal end edges of the elastic regulating member. However, this method involves a drawback that the elastic regulating member is vibrated by the rotation of the sleeve through friction therewith with the result that the toner is leaked between the edges of the elastic regulating member and the scatter preventing member to be scattered around. Additionally, the leakage prevention effect is not sufficient. Another method is to more strongly fix the edges of the elastic regulating member to the supporting member, which, however, results in that the opposite ends of the regulating member is more strongly pushed to the sleeve at the end portions than in the central portion, and therefore, the image becomes non-uniform.

FIG. 3 shows another possibility wherein gate members 61 and 62 are disposed in contact with the sleeve 2 before the elastic regulating member 5, and the developer is supplied to the member 5 with a width smaller than that of the member 5, by which the regulated developer layer 3 is limited into the area A within the elastic regulating member, so that the developer does not reach the edges of the regulating member. This would be considered as a measure. It is further considered that the portion A in which the developer layer is formed on the sleeve 2 is formed into a roughened surface by sand-blasting or abrading it with sandpaper or the like, as disclosed in the aforementioned U.S. Pat. Nos. 4,395,476 and 4,380,966, whereas the area outside the portion A wherein the developer layer is not formed is remained smooth to increase the close-contactness between the elastic regulating member and the smooth surface portion to prevent leakage of the developer. However, with long term use of the device, a part of the developer in the A region moves gradually although the amount thereof is very small, but to such an extent that the developer is blocked by the smooth surface portion 2' of the sleeve and the elastic regulating member 5 and is accumulated resulting in accumulation of the developer. The accumulated developer is gradually pushed toward the end portions, and finally pushed away from the end edges of the elastic regulating member. If this occurs, the developer falls outside the developing device to contaminate the electrophotographic apparatus, since the smooth surface has small conveying and retaining force for the developer. Or, if the accumulation becomes large, it pushes the elastic regulating member, and fall and scatter as described above, or the regulating effect to the developer layer at the portion A is weakened to deteriorate the uniformity of the developer layer, with the result that the resultant image becomes non-uniform.

In an apparatus wherein a magnetic curtain is formed between the magnetic regulating member and the sleeve, to regulate the thickness of the developer layer, the developer accumulated adjacent the end edge of the magnetic regulating member is overflowed to contaminate the apparatus.

SUMMARY OF THE INVENTION

Accordingly it is a principal object of the present invention to provide a developing apparatus of the type wherein a thickness of a developer layer is regulated by a regulating member, wherein the developer scattering is prevented or minimized adjacent edge portions of the regulating member.

It is another object of the present invention to provide a developing apparatus wherein the scattering of the developer is minimized adjacent opposite ends of the regulating member with a simple structure.

It is a further object of the present invention to provide a developing apparatus wherein the developer scattering is prevented or minimized adjacent opposite ends of the regulating member without local stress to the regulating member.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 5:
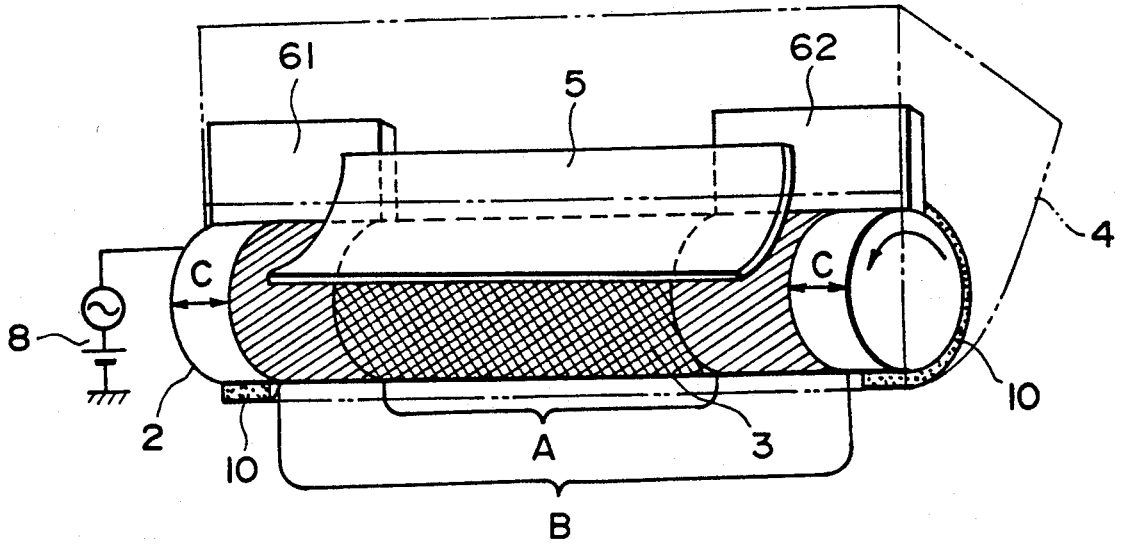
FIG. 5 is a perspective view of a major portion of a developing apparatus according to an embodiment of the present invention.

Referring to FIG. 5, a developing sleeve 2 is supplied with a developer from a developer container 4. The sleeve 2 is rotatable in the direction indicated by an arrow to carry the developer thereon. At a position upstream of a contact position between the sleeve 2 and an elastic regulating member 5 in the form of a plate with respect to the rotational direction of the sleeve 2, gate members 61 and 62 are disposed with space in the longitudinal direction of the sleeve 2 and in contact with or with small space from the surface of the sleeve 2. The space between the gate members 61 and 62 measured in the longitudinal direction of the sleeve is generally equal to the width of the region A. The developer supplied from the container 4 moves to the contact position between the regulating member 5 and the sleeve 2 through the space between the gate members 61 and 62. The regulating member 5 forms a developer layer 3 having a predetermined thickness with the width equal to that of the A region. The thickness of the developer layer 3 is preferably smaller than the clearance between the sleeve 2 and the photosensitive member 1 in a developing zone where the sleeve 2 is opposed to the photosensitive member 1, and the developer is supplied from the sleeve 2 to the photosensitive member 1. However, this is not inevitable.

As shown in the Figure, the width in which the elastic regulating member 5 is contacted to the sleeve 2 is larger than the width of the region A. Here, the "width" in this specification means a dimension measured in a direction perpendicular to the direction of the developer conveyance. Therefore, in the case where the developer carrying member is in the form of a cylindrical rotatable member, the width is a dimension measured along the longitudinal axis thereof.

The width of the region in which a latent image is formed on the photosensitive member 1, is preferably substantially equal to or smaller than the width of the region A.

In FIG. 5, the surface of the sleeve is a roughened surface in the region indicated by a reference B. The width of the roughened surface region B is larger than the width of the contact portion between the elastic regulating member 5 and the sleeve 2. Therefore, the entirety of the contact portion from one end thereof to the other end is within the roughened surface region B.

The roughened surface can be provided by sandblasting the region B of the sleeve 2 with spherical particles, irregular particles having sharp edges or a mixture thereof or by abrading the region B with abrasive particles such as sand paper. Another method of roughened surface formation is usable. In the example of FIG. 5, the region B is roughened by sandblasting treatment with irregular particles of 400 mesh.

The elastic regulating member 5 is fixed to the container 4 at its one end with screws or a bonding agent, and is resiliently contacted adjacent its free end by the elastic force provided by bending the member 5. It is preferable that an antinoding side of the bent regulating member 5 is contacted to the sleeve 2 than that the free end edge is contacted to the sleeve 2.

The elastic regulating member 5 may be a rubber elastic plate such as urethane rubber plate, silicone rubber plate and NBR plate or the like, a metal elastic plate such as phosphor bronze plate, a stainless steel plate or the like, or a synthetic resin elastic plate such as polyethyleneterephthalate plate, a high density polyethylene plate or the like. When a rubber elastic plate is used, it preferably has a hardness of $50\times10^6-80\times10^6$ kg/cm$^2$ (JIS K6301), a Young's modulus of 20–60 kg/cm$^2$, and a thickness of 0.5–2.0 mm. It is preferably pressed against the sleeve 2 with the force of 5–80 g/cm along the axis of the sleeve. When a metal elastic plate is used, it preferably has a Young's modulus of $0.7\times10^6-2.0\times10^6$ kg/cm$^2$, and a thickness of 0.1–0.5 mm. This is preferably pressed against the sleeve 2 with the force of 5–80 g/cm along the axis of the sleeve. If one of the synthetic resin material elastic plates is used, it preferably has a Young's modulus of $7.0\times10^{-3}-4.0\times10^4$ kg/cm$^2$ and a thickness of 0.2–1.0 mm. This is preferably pressed against the sleeve 2 with the force of 5–80 g/cm along the length of the sleeve. However, the present invention is not limited within the above numerical range.

Figure 1:
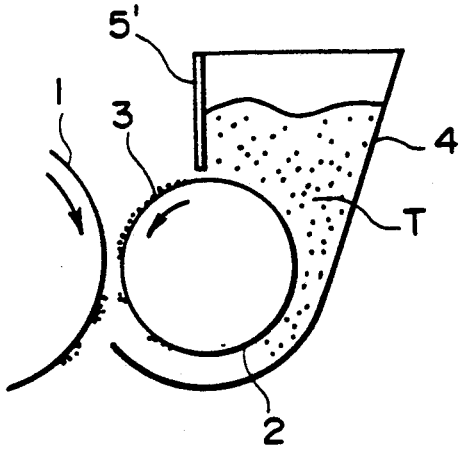
FIG. 1 PRIOR ART
FIG. 1 is a sectional view of a prior art developing device.
Figure 2:
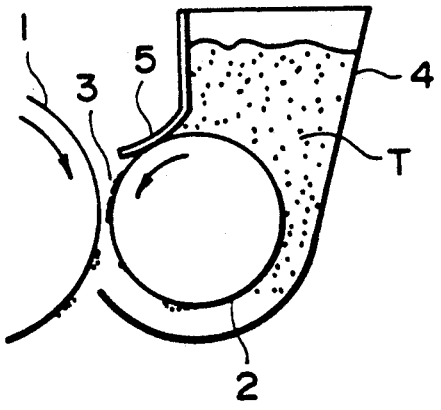
FIG. 2 PRIOR ART
FIG. 2 is a sectional view of another prior art developing device.
Figure 3:
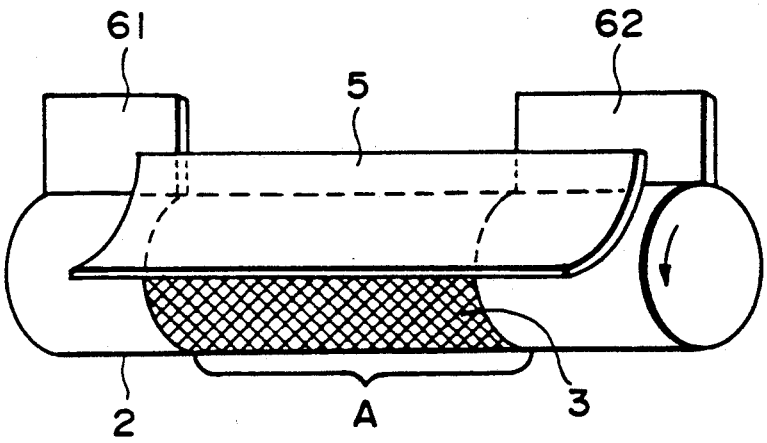
FIG. 3 PRIOR ART
FIG. 3 is a perspective view of a major portion of FIG. 2 apparatus.
Figure 4:
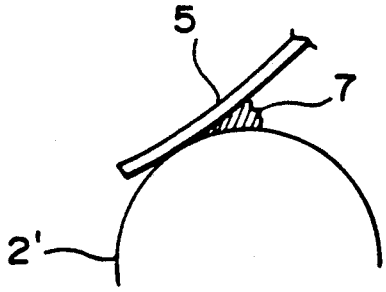
FIG. 4 PRIOR ART
FIG. 4 is a sectional view of a developing apparatus illustrating causes of the developer scattering.

In operation, the sleeve 2 is rotated. In the initial stage of rotations, the formed developer layer 3 has a width equal to the width of the region A. With continued rotation, a part of the developer is gradually leaked toward the end portions of the elastic regulating member 5, as described hereinbefore. However, the leaked developer is not formed into the accumulation 7 as shown in FIG. 4, instead, it is moved under the member 5 to be brought out thereof since the roughened surface of the sleeve provides strong developer conveying force, by which a developer layer is formed on the sleeve 2 and is returned into the container. Then, the width of the developer layer 3 gradually expands from the original width A, and eventually it reaches to the end portions, that is, the developer layer 3 covers the entire width of the elastic regulating member 5.

As a result, the developer leaks away from the end edges of the elastic regulating member 5. Here, however, the roughened surface extends beyond the contact width of the elastic regulating member 5, and therefore, the overflowed developer is given sufficient conveying force, and therefore, it is gradually conveyed always. Accordingly, the developer does not accumulate at end portions of the elastic regulating member 5 to such an extent that the developer falls or scatters, but it is returned into the developer container. The amount of the leaked developer is very small in long term, and therefore, the leaked developer is not formed into a very non-uniform layer although it is outside the regulating region of the elastic regulating member 5. Thus, the contamination and the influence to the image can be completely negligible.

The developing device shown in FIG. 5 is applicable to the case where a magnetic one component developer is used or to the case where non-magnetic one component developer is used in the similar manner. In the former case, a magnet functioning as a magnetic field generating means is disposed inside the sleeve 2, and it is rotated, or fixed in relation to the latent image bearing member 1. The width of the magnetic field generating means is longer than the width of the elastic regulating member 5 and not longer than the width of the roughened surface range B, by which the above-described scatter preventing conveying force is sufficient. This is because the magnetic field is formed within the range B and adjacent and outside of the contact region between the elastic regulating member 5 and the sleeve 2, and therefore, the magnetic developer is retained on the sleeve 2 by the magnetic field.

Outside the region B of the sleeve 2 is smooth surface C. In the smooth surface region C, a soft sealing member 10 made of felt, moltplane or the like fixed to the container 4 is contacted to the sleeve 2. The sealing member 10 is wrapped around the region C of the sleeve 2 in the container 4, as shown in FIG. 5, by which the developer in the container 4 is prevented from leaking out. By contacting the sealing member 10 to the smooth surface region C, the wearing and damage of the sealing member 10 is minimized, and also the developer is prevented from leaking out through between the sealing member 10 and the sleeve 2.

A power source 8 supplies a developing bias voltage to the sleeve 2. The voltage supplied by the source 8 is a superposed DC and AC voltages, the AC voltage being in the form of a sine wave or rectangular wave by application of such a voltage, a vibrating electric field is formed in the developing zone. By regulating the thickness of the developer layer by contacting an elastic regulating member 5 to the sleeve 2, a very thin developer layer can be provided, and therefore, the formation of the vibrating electric field in the developing zone is preferable in order to increase the efficiency of the developments by thin developer layer. However, the present invention is applicable to a developing apparatus wherein a DC bias voltage is applied to the developing sleeve 2.

Figure 6:
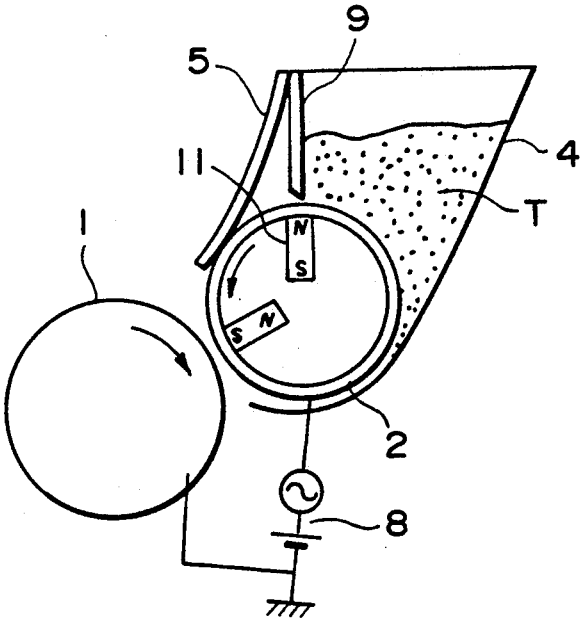
FIG. 6 is a sectional view of a developing apparatus according to another embodiment of the present invention.
Figure 7:
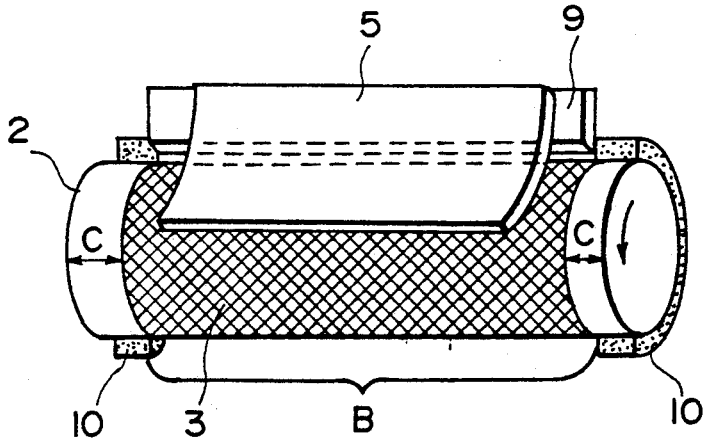
FIG. 7 is a perspective view of the FIG. 6 developing apparatus.

FIGS. 6 and 7 show an example wherein two of developer layer thickness regulating members are used. One of the regulating members 9 is a magnetic blade made of iron or the like, which is opposed to one of magnetic poles of a magnet 11 stationarily disposed within the sleeve 2. The magnetic blade 9 is spaced apart from the sleeve 2 with a uniform small clearance over the entire width of the region B. As disclosed in U.S. Pat. No. 4,387,664, the magnetic blade 9 is etfective to strongly to concentrate the magnetic flux of the magnet 11 to the blade 9 to form a magnetic curtain between the sleeve 2 and the blade 9, the magnetic curtain being effective to confine the magnetic developer. This forms a magnetic developer layer having a thickness smaller than the small clearance. Downstream of the magnetic blade 9 with respect to the rotational direction of the sleeve 2, an elastic regulating member 5 is contacted to the sleeve 2. The elastic regulating member 5 is effective to further reduce the thickness of the developer layer formed by the magnetic blade 9, and also, increases the triboelectric charge of the developer.

As shown in FIG. 7, the width of the magnetic blade 9 is larger than the width of the elastic regulating member 5 and is not longer than the width of the roughened surface region B. The width of the roughened surface region B is larger than the width of the elastic regulating member 5. By doing so, the developing device is stable against variation in the ambient conditions and without scattering of the developer from the end edges of the elastic regulating member. It is effective in order to prevent scatter and leakage of the developer from the ends of the elastic regulating member 5 that the magnetic field generating means 11 disposed within the sleeve in opposition to the magnetic blade 9 has a width larger than the width of the elastic regulating member 5 and that it is equal to the width of the developer layer formed by the magnetic blade 9, and therefore, to the width of the roughened surface region B. The surface of the sleeve 2 outside the magnetic blade 9 may be a smooth surface C, and the leakage of the toner to the region C can be prevented by one of known methods, for example, by a sealing member 10 made of felt, moltplane or the like to the region C of the sleeve 2.

When non-magnetic one component developer is used, the apparatus shown in FIG. 5 can be used, wherein the magnet within the sleeve 2 is not necessary. Also, in that case, the sleeve 2 may be replaced with a solid cylindrical member.

As disclosed in U.S. Pat. No. 4,548,489 and Japanese Laid-Open Patent Application 101680/1984, in an apparatus wherein a mixture of non-magnetic toner and magnetic carrier particles are contained and stirred in the container 4, and substantially only nonmagnetic toner particles are conveyed to the developing zone, it is effective in order to prevent the scattering and leakage of the magnetic carrier particles that the magnetic field generating means within the sleeve has a width corresponding to the width of the region A. By contacting the elastic regulating member to the sleeve 2, it is possible to allow only the toner particles to pass through the contact area between the sleeve and the regulating member, since the particle size of the carrier is larger than the particle size of the toner.

In this specification, the "contact of the elastic regulating member to the sleeve", means that when the developer is not present, the elastic regulating member is directly contacted to the sleeve, but when the developer is present, the regulating member is resiliently urged to the sleeve to press the thin developer layer to the sleeve 2.

Figure 8:
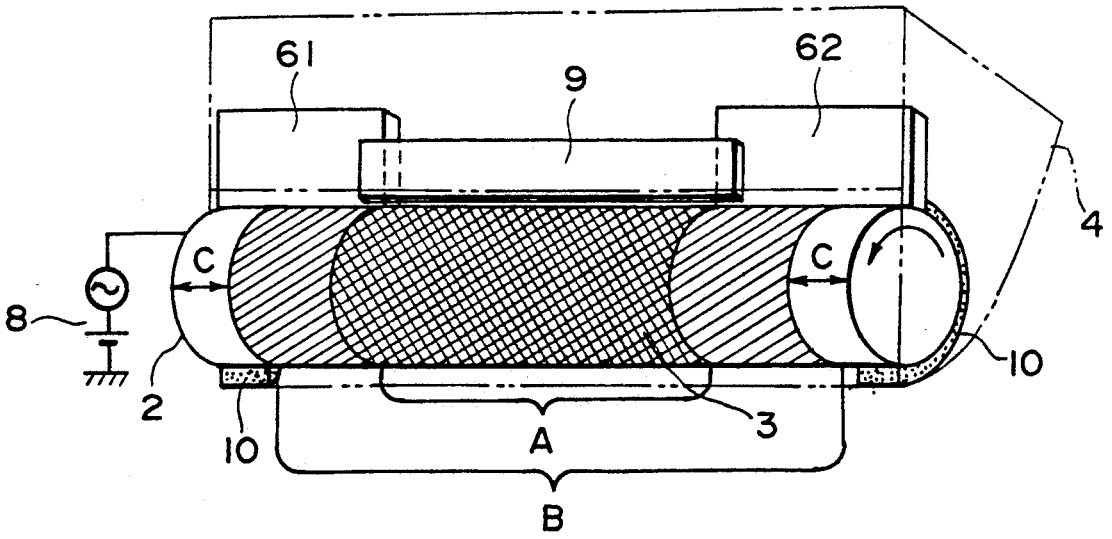
FIG. 8 is a perspective view of a developing apparatus according to a further embodiment of the present invention.
Figure 9:
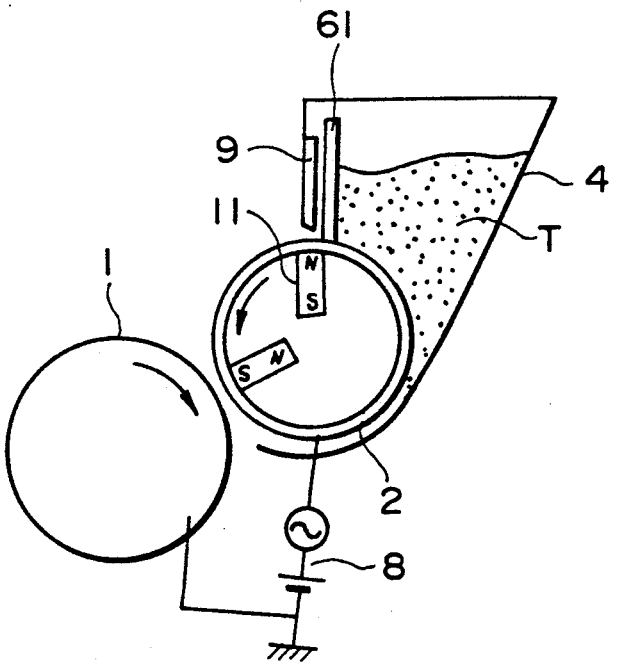
FIG. 9 is a sectional view of the FIG. 8 developing apparatus.

FIGS. 8 and 9 show an example wherein the elastic regulating member of FIG. 5 is replaced with a magnetic blade 9 made of iron or the like. The magnetic blade 9 is disposed with a uniform small clearance with the sleeve 2 over its entire width, and is opposed to a magnetic pole of the magnet 10 which is stationarily disposed in the sleeve 2. In the similar manner as described with FIGS. 6 and 7, a thin developer layer 3 is formed. As shown in FIG. 8, the width of the roughened surface region B is larger than the width of the magnetic blade 9 measured along the axis of the sleeve. By doing so, the developer tending to accumulate adjacent the edges of the blade 9 and the developer having leaked out of the edges, are conveyed by strong conveying force provided by the roughened surface B, so that the developer scatter is prevented.

Figure 10:
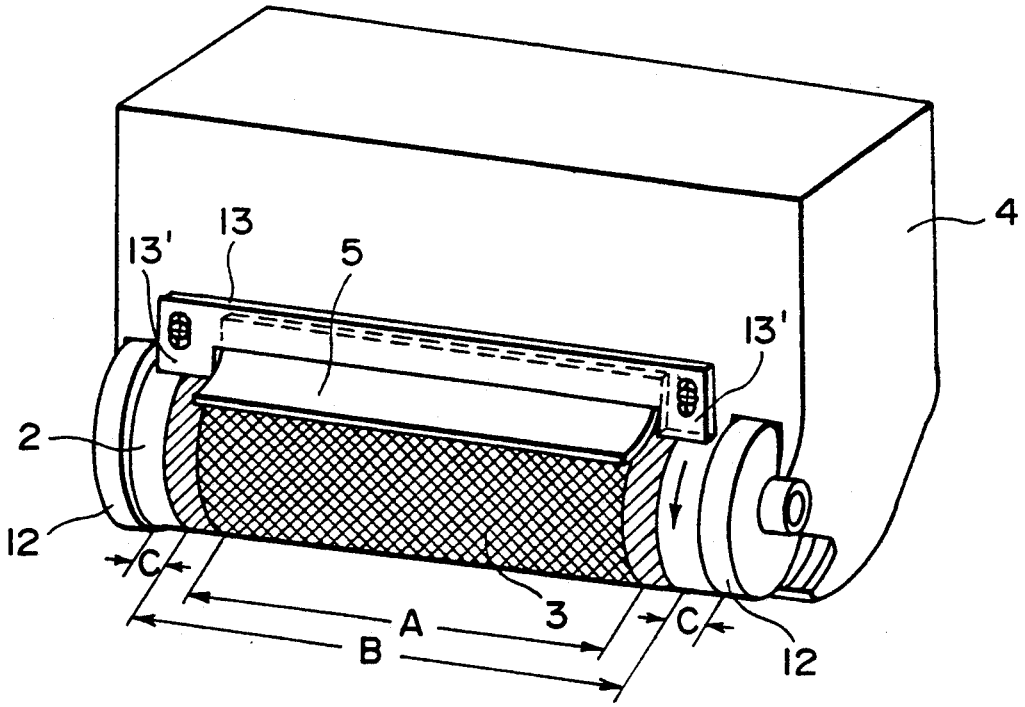
FIG. 10 is a perspective view of a developing apparatus according to a further embodiment of the present invention.
Figure 11:
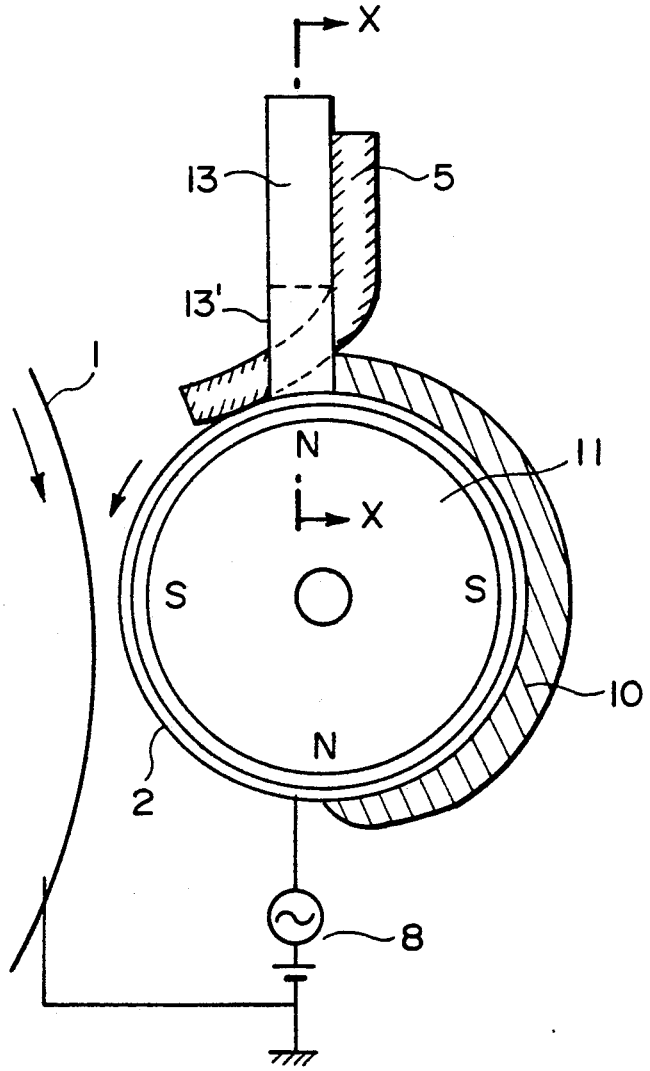
FIG. 11 is a sectional view of a major portion of the FIG. 10 apparatus.

Referring to FIG. 10, a sleeve made of non-magnetic material such as aluminum, stainless steel or the like is rotatable in the direction indicated by an arrow, and contains a stationary magnet 10 (FIG. 11). The sleeve is effective to carry magnetic toner layer 3 to oppose the toner in the developing zone to an electrophotographic photosensitive member 1 (FIG. 11) rotating in the direction indicated by an arrow. Spacer rollers 12 coaxial with the sleeve 2 are contacted to the photosensitive member 1 to retain a predetermined clearance between the sleeve 2 and the photosensitive member 1. A container 4 contains the toner and supplies it to the sleeve 2. A magnetic member 13 in the form of a plate is made of magnetic stainless steel, iron or the like and is provided at opposite ends projections 13' extending downwardly with their free ends close to the sleeve 2. The magnetic plate 13 is fixed to the container 4. In the region between the two projections 13' of the magnetic plate 13, an elastic blade 5 as the developer layer thickness regulating member is fixed by screws or bonding agent. The projections 13' serve as magnetic sealing member to confine leakage of the toner, which will be described hereinafter.

The blade 5, as described hereinbefore, is made of rubber elastic material such as urethane rubber, silicone rubber and NBR rubber, or metal elastic material such as phosphor bronze, stainless steel or a synthetic resin material such as polyethyleneterephthalate or the like, and it is resiliently contacted to the sleeve 2.

As will be understood from FIG. 11, an end of the blade 5, more particularly, an upper end, of the blade 5 is fixed to an upstream side surface of the plate 13 with respect to the rotational direction of the sleeve, and the blade 5 is curved and is extended under the plate 13, and the free end of the blade is disposed downstream of the projections 13' with respect to the rotational direction of the sleeve. By doing so, the contact portion between the blade 5 and the sleeve 2 can be disposed close to the projections 13', and therefore, the toner scattering can be effectively prevented adjacent the end of the blade 5 in the direction of its width. When the blade 5 is disposed counterdirectionally with respect to the sleeve rotational direction, the upper end of the blade 5 is fixed to the downstream side surface of the plate 13 with respect to the sleeve rotational direction, and the blade 5 is extended downwardly under the plate 13, and the blade free end is disposed upstream of the projections 13'. However, those are not inevitable.

It is preferable that the contact portion between the elastic blade 5 and the sleeve 2 is substantially at the same position with the magnetic sealing member 13' in the direction of the axis of the sleeve 2, or it is slightly downstream of the magnetic sealing member 13' with respect to the rotational direction of the sleeve. However, it is possible that the magnetic sealing member 13' may be slightly downstream of the contact portion with respect to the rotational direction of the sleeve. In any case, the magnetic sealing member 13' is within the influence of the magnetic field provided by the magnet 11. The member 13' is preferably opposed to one of the magnetic poles of the magnet 11, but may be deviated more or less. The toner in the container 4 is attracted onto the sleeve 2 by the magnetic force, and is frictioned between the blade 5 and the developing sleeve 2 with the rotation of the sleeve, by which it is formed into a thin layer and also is triboelectrically charged. Then, it is carried to the developing zone where the toner develops the latent image on the drum 1 by application of the bias voltage between the sleeve 2 and the drum 1. The problems here are toner scattering and falling of the toner at the ends of the blade 5. In this embodiment, the magnetic sealing effect at the end portions of the blades provided by the magnetic plate 13' and the magnet 11 within the sleeve, prevents the toner from scattering.

Figure 12:
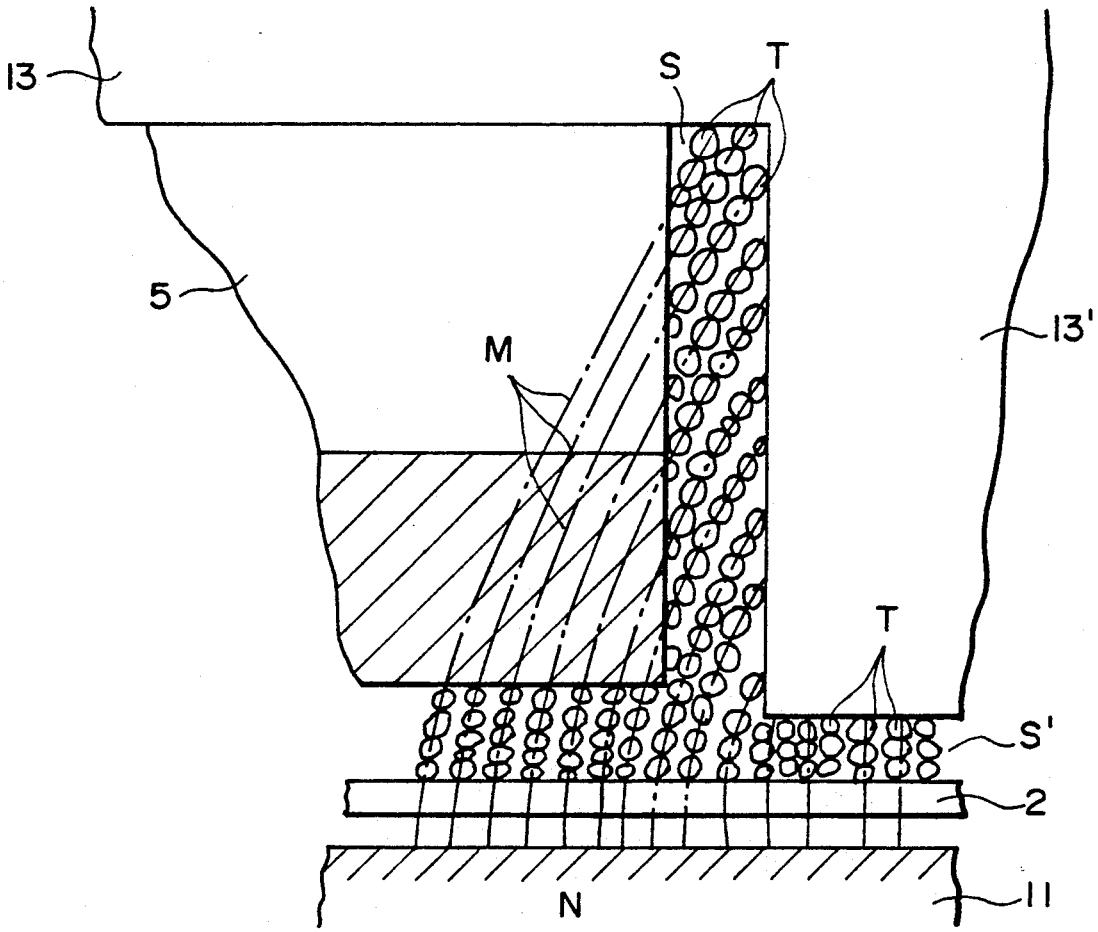
FIG. 12 is a sectional view of the FIG. 10 apparatus illustrating the magnetic seal.

Referring to FIG. 12, the description will be made with respect to this point, the FIG. 12 being a sectional view taken along X—X in FIG. 11. In FIG. 12, on the magnetic sealing member 13', the magnetic field provided by the magnetic pole (N-pole in the Figure) of the magnet 11 opposed to the sealing member 13' through the sleeve 2, so that the magnetic lines of force are concentrated at a high density as shown by chain lines M in this Figure. Therefore, a high density toner barrier T along the magnetic lines of force is formed in the clearance S between the blade 5 and the member 13' and in the clearance S' between the sleeve 2 and the member 13'. By the toner barrier T, the toner having been blocked by the blade 5 and having moved to the neighborhood of the end portions is prevented from scattering and falling.

The magnetic plate 13' and the sleeve 2 may be close contacted, but several hundreds microns gap may be provided therebetween so as to prevent wearing and torque increase by the friction, and in this case, the magnetic seal is effective to prevent a mass of the toner from falling. A toner layer having a thickness smaller than the clearance S' is continuously produced, and the apparatus is not easily contaminated. The toner layer is formed within the region B but outside the region A in FIG. 10. In the region A, the elastic blade 5 is contacted to the sleeve. The region B is broader than the region A, and therefore, the region A is within the region B. The magnetic sealing member 13' is opposed to the opposite ends of the region B.

Similarly to the foregoing embodiments, the surface of the sleeve in the region B is preferably formed into a roughened surface provided by sandblasting it or abrading it with sandpaper. By doing so, the toner conveying force is enhanced, and therefore, the conveying force within the region B and outside the region A is increased so as to assure the toner to be returned into the container 4.

Figure 13:
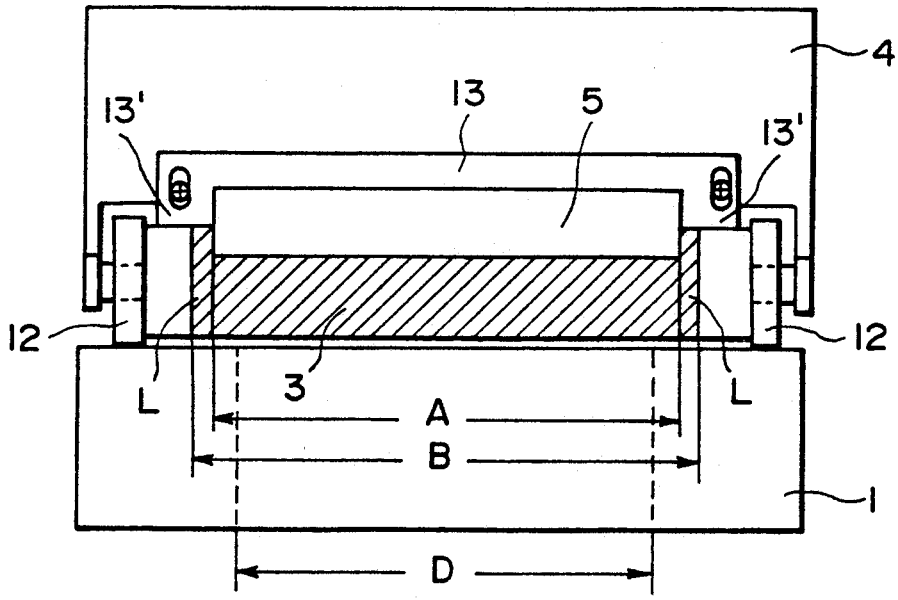
FIG. 13 illustrates a relation with the FIG. 10 apparatus and the photosensitive member.

Another advantage of the region B larger than the width of the blade 5 contacted to the sleeve 2 (the width of the region A measured in the direction perpendicular to the toner conveyance) will be explained. Although the toner leakage in the form of scattering or mass falling is prevented by the magnetic seal, a toner layer L having a thickness lightly larger than that in the region A is produced through the clearance S adjacent the blade ends, as shown in FIG. 13. In order to assure the toner layer to be returned into the container, it is effective that the surface of the sleeve in the region B including the region in which the slightly thick toner layer is formed is roughened so as to increase the toner conveying property. Although those are preferable, they are not inevitable, and it is still good that only the region A or a region smaller than the region A are roughened. The toner layer L is effective to prevent the inside toner (region A) expanding outside.

A region C which is outside the region B has a smooth or mirror surface, and in the region C, and in the container 4, a soft sealing member 10 made of felt or moltplane is contacted to the sleeve 2 to prevent toner movement toward end of the sleeve, and therefore, to prevent the scattering.

As shown in FIG. 13, it is preferable that the width of the region A is larger than the width of the image portion on the photosensitive drum 1 (the portion exposed to light information to be recorded) this is done in order to prevent the toner layer L from forming noise in the image portion.

The magnetic sealing member 13' is disposed outside the opposite ends of the elastic blade 5. Here, the end of the blade 5 and the magnetic sealing member 13' may be contacted, but it is preferable in order to make the blade 5 movable freely in the direction of urging it to the sleeve 2, particularly when the blade 5 is made of a soft rubber elastic member such as rubber, that the clearance of 0.1–0.2 mm or not more than 0.5 mm is formed between the blade 5 and seal member 13'. This is in order to prevent the toner scattering into the air due to the vibration of the elastic blade 5 by the friction with the sealing member 13'. By strongly pressing the blade 5 and the sealing member 13', it is possible to suppress the vibration, but it will make the blade contact pressure non-uniform.

The member 13' may be made of a magnet. For example, it may be an S-pole magnet opposed to the N-pole of the magnet 11, by which a concentrated magnetic field is formed. In this specification, such a magnet is called also a magnetic member.

In addition to the one component magnetic developer, a two component developer which is a mixture of a non-magnetic toner and magnetic carrier made of iron particles or the like, is usable. In that case, the barrier T in FIG. 12 functions as a carrier barrier to prevent the carrier or toner from scattering or dropping in the form of a mass.

Figure 14:
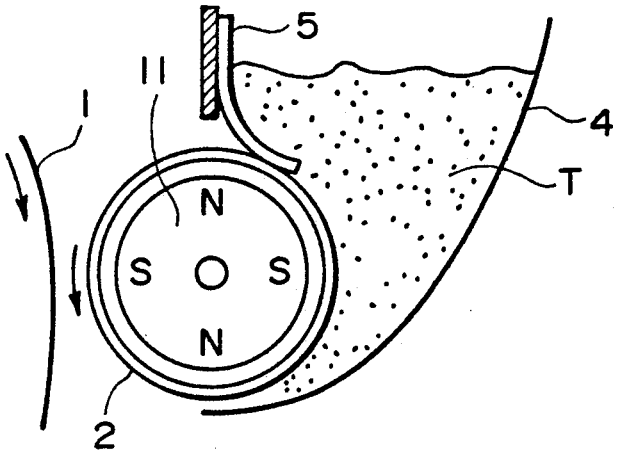
FIG. 14 is a sectional view of a developing apparatus illustrating arrangement of an elastic blade.

In this embodiment, the blade 5 as the elastic regulating member is codirectionally contacted to the sleeve with respect to its rotational direction, but it may be counter-directionally contacted, as shown in FIG. 14.

The codirectional contact means that the free end of the blade 5 is downstream of its fixed end with respect to the rotational direction of the sleeve. The counter directional contact means that the free end of the blade 5 is upstream of the fixed end with respect to the same direction.

The region B of the sleeve surface has a roughness of 0.1–8 microns with a fine pitch of convex portions of 2–50 microns, preferably. The surface roughness is determined by JIS ten point average roughness (Rz) (JIS B0601). More particularly, in a cross-section of the roughened surface, a reference length l is taken out, and an average height line is drawn. A line parallel to the average line and passing through a third highest peak and a line parallel thereto passing through the third lowest root. The distance between those two lines is the roughness microns). The reference length was 0.25 mm. The pitch is determined as 250 microns/Number of peak (P) in the length of 250 microns.

The peak is defined as a peak having a height not less than 0.1 micron relative to the adjacent both side roots.

The cross-section of the surface was determined by a fine surface roughness meter available from Tailor Bobson or Kosaka Kenkyusho.

The toner particle size is 5–30 microns on the average, preferably 5–15 microns, and ordinary toner is usable.

In the foregoing embodiments, the object on which the developer layer thickness regulating member acts is a developing sleeve or a developing roller opposed to the image bearing member to apply the developer thereto. However, the present invention is applicable to the case where the object on which the developer layer thickness regulating member is a developer applying sleeve or roller for applying a developer to the developing sleeve or roller.

Figure 15:
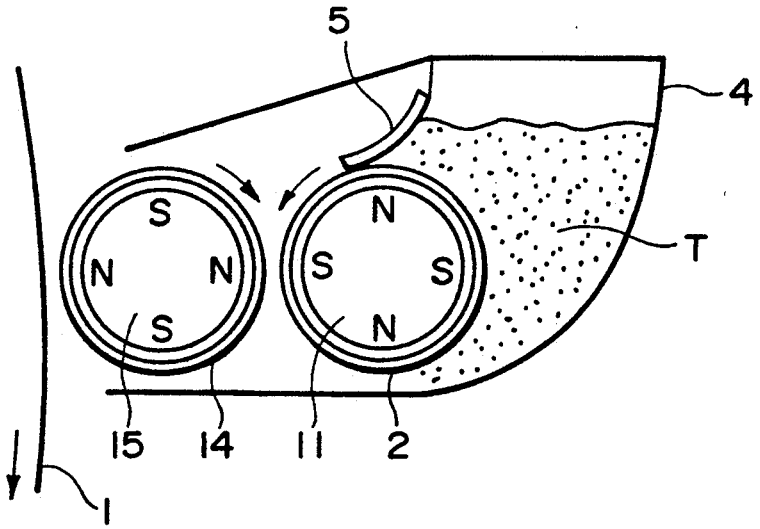
FIG. 15 is a sectional view according to a yet further embodiment of the present invention.

FIG. 15 shows an example of such an apparatus, wherein the sleeve 2 functions not as a developing sleeve but as a developing applying sleeve. A developing sleeve 14 containing a stationary magnet 15 carries the developer applied from the sleeve 2 to the developing zone. Non-magnetic developer is usable.

While the invention has been described with to the structures disclosed herein, it is not confined to the details set forth and this application is intended to cover such modifications or changes as may come within the purposes of the improvements or the scope of the following claims.

What is claimed is:

1. A developing apparatus, comprising:

a developer carrying member for carrying a magnetic developer;

means for supplying the developer to said developer carrying member;

an elastic regulating member contacting said developer carrying member for regulating a thickness of a layer of the developer formed on said developer carrying member; and a magnet disposed in said developer carrying member;

wherein said developer carrying member has a roughened surface over a width thereof larger than a width of the portion of said elastic regulating member contacting said developer carrying member, and wherein said magnet forms a magnetic field in a marginal region of the roughened surface of said developer carrying member not contacting said elastic regulating member, for removing the magnetic developer.

2. An apparatus according to claim 1, wherein said supplying means is provided with a developer outlet at a position upstream of the contact between said elastic regulating member and said developer carrying member with respect to movement direction of said developer carrying member, wherein the developer is delivered through the outlet to said contact portion, said outlet having a width smaller than the width of the contact portion.

3. An apparatus according to claim 1, wherein said contact portion has a width larger than a width of an image forming region of an image bearing member to which said developer carrying member is opposed.

4. An apparatus according to claim 1, wherein said developer carrying member has a smooth surface outside the roughened surface region, and wherein said supplying means includes a sealing member contacted to the smooth surface region.

5. An apparatus according to any one of claims 1–4, wherein the roughened surface is produced by blasting particles.

6. An apparatus according to any one of claims 1–4, wherein the roughened surface is formed by rubbing a surface of said developer carrying member with particles.

7. An apparatus according to any one of claims 1–4, further comprising means for forming a vibratory electric field between said developer carrying member and an image bearing member to which it is opposed.

8. A developing apparatus, comprising:

a rotatable member for carrying a magnetic developer;

a magnet stationarily disposed in said rotatable member;

means for supplying a developer to said rotatable member;

an elastic regulating member contacting said rotatable member, for regulating a thickness of a layer of the developer formed on said rotatable member; and a magnetic sealing member disposed opposed to said rotatable member adjacent ends of said elastic regulating member, said magnetic sealing member being disposed within an influence of said magnet, wherein said rotatable member has a roughened surface having a width larger than a width of a contact portion between said elastic regulating member and said rotatable member.

9. An apparatus according to claim 8, wherein said magnetic sealing member is opposed to the roughened surface.

10. An apparatus according to claim 9, wherein said rotatable member has a smooth surface outside the roughened surface region, and wherein said supplying means has a sealing member contacted to the smooth area.

11. An apparatus according to any one of claims 8–10, wherein said magnetic sealing member is disposed outside the ends of said elastic regulating member in a direction of its width.

12. An apparatus according to any one of claims 8–10, further comprising a supporting member integral with said magnetic sealing member for supporting said elastic regulating member, wherein said magnetic sealing member is projected from said supporting member toward said rotatable member.

13. An apparatus according to any one of claims 8–10, wherein said roughened surface is provided by blasting particles.

14. An apparatus according to any one of claims 8–10, wherein said roughened surface is provided by rubbing a surface of said rotatable member with particles.

15. A developing apparatus comprising:

a rotatable member for carrying a magnetic developer;

a magnet stationarily disposed in said rotatable member;

means for supplying a developer to said rotatable member;

an elastic regulating member contacting said rotatable member, for regulating a thickness of a layer of the developer formed on said rotatable member; and a magnetic sealing member disposed opposed to said rotatable member adjacent ends of said elastic regulating member, said magnetic sealing member being disposed within an influence of said magnet, said magnetic sealing member being disposed outside the ends of said elastic regulating member in a direction of its width, wherein said rotatable member has a roughened surface having a width larger than a width of a contact portion between said elastic regulating member and said rotatable member, and wherein said magnetic sealing member is opposed to the roughened surface.

16. An apparatus according to claim 15, further comprising a supporting member integral with said magnetic sealing member for supporting said elastic regulating member, wherein said magnetic sealing member is projected from said supporting member toward said rotatable member, said elastic regulating member is curved and is extended between said supporting member and said rotatable member.

17. A developing apparatus comprising:

a rotatable member for carrying a magnetic developer;

a magnet stationarily disposed in said rotatable member;

means for supplying a developer to said rotatable member;

an elastic regulating member contacting said rotatable member, for regulating a thickness of a layer of the developer formed on said rotatable member;

a magnetic sealing member disposed opposed to said rotatable member adjacent ends of said elastic regulating member, said magnetic sealing member being disposed within an influence of said magnet; and a supporting member integral with said magnetic sealing member for supporting said elastic regulating member;

wherein said magnetic sealing member is projected from said supporting member toward said rotatable member, wherein said rotatable member has a roughened surface having a width larger than a width of a contact portion between said elastic regulating member and said rotatable member, and wherein said magnetic sealing member is opposed to the roughened surface.

* * * * *

UNITED STATES PATENT AND TRADEMARK OFFICE

CERTIFICATE OF CORRECTION

PATENT NO. : 5,084,733

DATED : January 28, 1992

INVENTOR(S) : MOTOI KATOH, ET AL.

It is certified that error appears in the above-indentified patent and that said Letters Patent is hereby corrected as shown below:

COLUMN 1

Line 55, "However, the" should read --However, when the--.

COLUMN 2

Line 17, "is" should read --are--.
Line 35, "is remained" should read --remains--.

COLUMN 6

Line 20, "etfec-" should read --effec- --.

COLUMN 9

Line 13, "lightly" should read --slightly--.
Line 34, "recorded) this" should read --recorded). This--.

UNITED STATES PATENT AND TRADEMARK OFFICE

CERTIFICATE OF CORRECTION

PATENT NO. : 5,084,733

DATED : January 28, 1992

INVENTOR(S) : MOTOI KATOH, ET AL.

It is certified that error appears in the above-indentified patent and that said Letters Patent is hereby corrected as shown below:

COLUMN 10

Line 17, "microns)." should read --(microns).--.
Line 43, "with to" should read --with reference to--.

Signed and Sealed this

Eighth Day of June, 1993

*Attest:*

Michael K. Kirk

MICHAEL K. KIRK

*Attesting Officer*

*Acting Commissioner of Patents and Trademarks*